US006441288B1

(12) United States Patent
Lin

(10) Patent No.: US 6,441,288 B1
(45) Date of Patent: Aug. 27, 2002

(54) GUITAR COVER FOR PROTECTING GUITAR SUPPORTED ON GUITAR STAND

(76) Inventor: Eddie Fong Cheng Lin, 3639 Hawkwood Rd., Diamond Bar, CA (US) 91765

( * ) Notice: Subject to any disclaimer, the term of this patent is extended or adjusted under 35 U.S.C. 154(b) by 0 days.

(21) Appl. No.: 09/760,553

(22) Filed: Jan. 17, 2001

(51) Int. Cl.[7] ..... G10G 7/00
(52) U.S. Cl. ..... 84/453; 84/327
(58) Field of Search ..... 84/453, 327, 380 B, 84/183

(56) References Cited

U.S. PATENT DOCUMENTS 4,738,180 A * 4/1988 McKnight ..... 84/385 A
5,875,890 A * 3/1999 Di Bernardini ..... 206/314
5,920,022 A * 7/1999 Ashwood, Jr. ..... 84/453

* cited by examiner

*Primary Examiner*—Shih-Yung Hsieh
(74) *Attorney, Agent, or Firm*—Raymond Y. Chan; David and Raymond Patent Group

(57) ABSTRACT

A guitar cover is adapted for protecting a guitar supported on a guitar stand, wherein the guitar cover includes a tubular body cover having a receiving chamber for receiving the guitar therein. The body cover has a back slit vertically formed on a back side of the guitar cover to communicate the receiving chamber with outside in such a manner that holding arms of the guitar stand are adapted for extending into the receiving chamber in order to hold the guitar in position.

20 Claims, 5 Drawing Sheets

GUITAR COVER FOR PROTECTING GUITAR SUPPORTED ON GUITAR STAND

BACKGROUND OF THE PRESENT INVENTION

1. Field of Invention

The present invention relates to guitars, and more particularly to a guitar cover for protecting a guitar supported on a guitar stand, wherein the guitar cover is adapted for adjustably fitting any size of the guitar thereinto and the user is hassle-free to withdraw the guitar from the guitar cover even the guitar is supported on the guitar stand.

2. Description of the Related Arts

Guitar is one of the most popular musical instruments. For convenience, the guitar is supported on a guitar stand so that people can play the guitar everyday whenever they have spare time. As shown in FIG. 1, the guitar stand 3 comprises a floor standing frame 31 for stabilization of the guitar stand 3, a supporting shaft 32 upwardly extended from the floor standing frame 31, and two Y-shaped holding arms 33 outwardly extended from the supporting shaft 32 for holding the guitar in an upright position.

Since the guitar is exposed in the surroundings, dust and dirt may easily strick on the guitar, which may affect the quality of the sound produced from the guitar. In order to protect the guitar supported on the guitar stand, the simplest way is to use a piece of cloth to fully cover up the guitar, Since the cloth cover is not tailor made for the guitar, the user may accidentally step on the cloth cover and force the guitar fell down on the floor, which will damage the guitar. Thus, the unfitted cloth cover may destroy the aesthetic appearance of the guitar.

Alternatively, an improved guitar cover is made such that the guitar is fitted into the guitar cover for protecting the guitar. However, the guitar cover is not designed for the guitar to be supported on the guitar stand so that the guitar cover may cause an unbalanced support of the guitar when it is placed on the guitar stand. Moreover, it is a hassle for the user to withdraw the guitar from the guitar cover every time when he or she wants to play and dispose the guitar back into the guitar cover after practice such that the user may ignore to use the guitar cover as well.

SUMMARY OF THE PRESENT INVENTION

A main object of the present invention is to provide a guitar cover for protecting guitar supported on a guitar stand wherein the guitar cover is adapted for incorporating with the guitar stand for well protecting and supporting the guitar.

Another object of the present invention is to provide a guitar cover for protecting a guitar on a guitar stand wherein the guitar cover is adjustably fitted for covering up any size of the guitar.

Another object of the present invention is to provide a guitar cover for protecting a guitar on a guitar stand wherein a user can directly take out the guitar from the guitar cover while the guitar is still supported on the guitar stand, which is a hassle-free for the user.

Another object of the present invention is to provide a guitar cover for protecting a guitar on a guitar stand wherein the guitar cover does not require to alter the original structural design of the guitar stand in order to support the guitar thereon, so as to minimize the cost of the incorporating the guitar cover with every conventional guitar cover.

Accordingly, in order to accomplish the above objects, the present invention provides a guitar cover for protecting a guitar while supporting on a guitar stand which comprises a floor standing frame for stabilization of the guitar stand, a supporting shaft upwardly extended from the floor standing frame, and two holding arms outwardly extended from the floor standing frame for holding the guitar in an upright position, wherein the guitar cover comprises a tubular body cover having a top opening, a bottom opening and a receiving chamber provided between the top opening and the bottom opening for fittedly receiving the guitar therein, wherein a back slit is formed on a back side of the body cover to communicate the receiving chamber with outside in such a manner that the holding arms of the guitar stand are adapted for extending into the receiving chamber through the back slit to hold the guitar in position.

DETAILED DESCRIPTION OF THE PREFERRED EMBODIMENT

Figure 1:
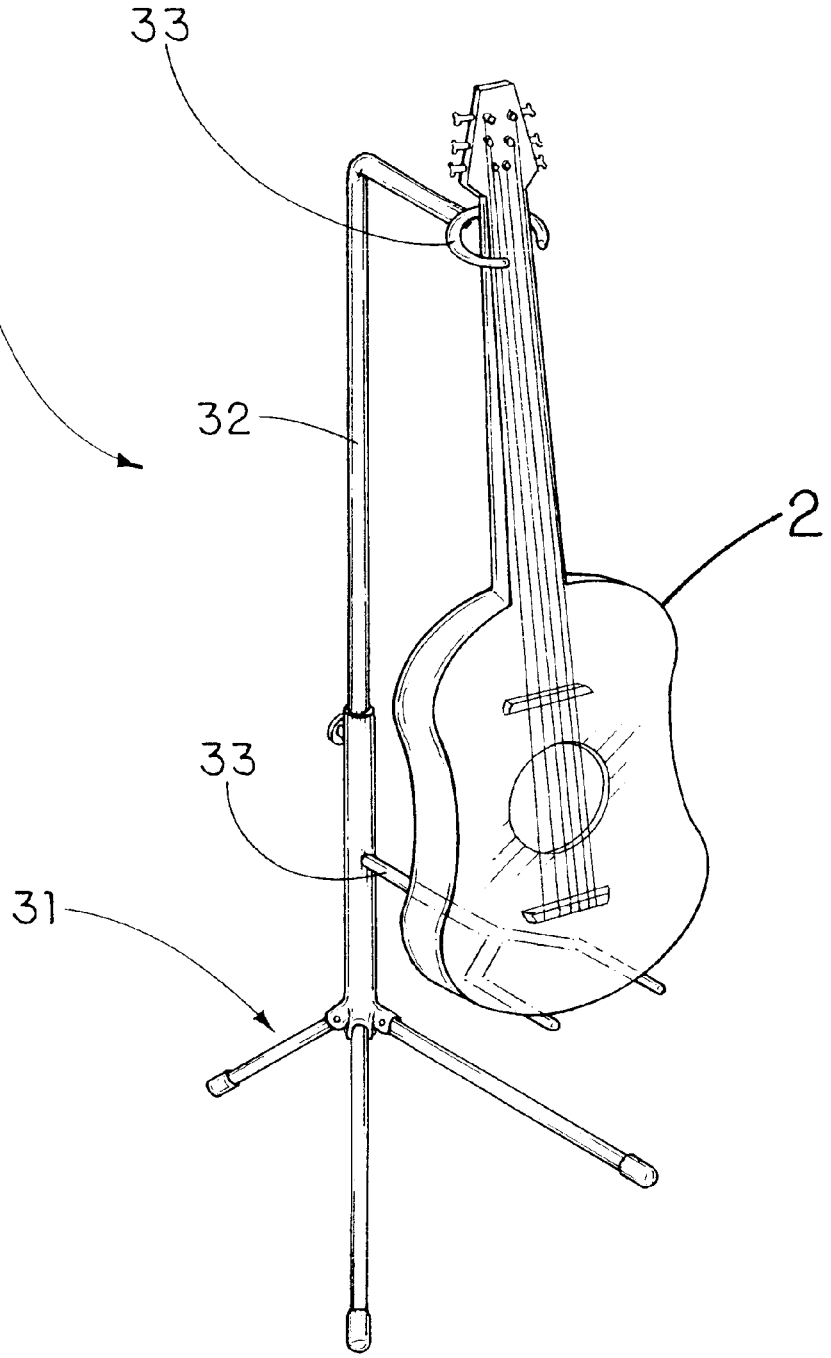
PRIOR ART FIG. 1
FIG. 1 is a perspective view of a guitar supported on a guitar stand.
Figure 2:
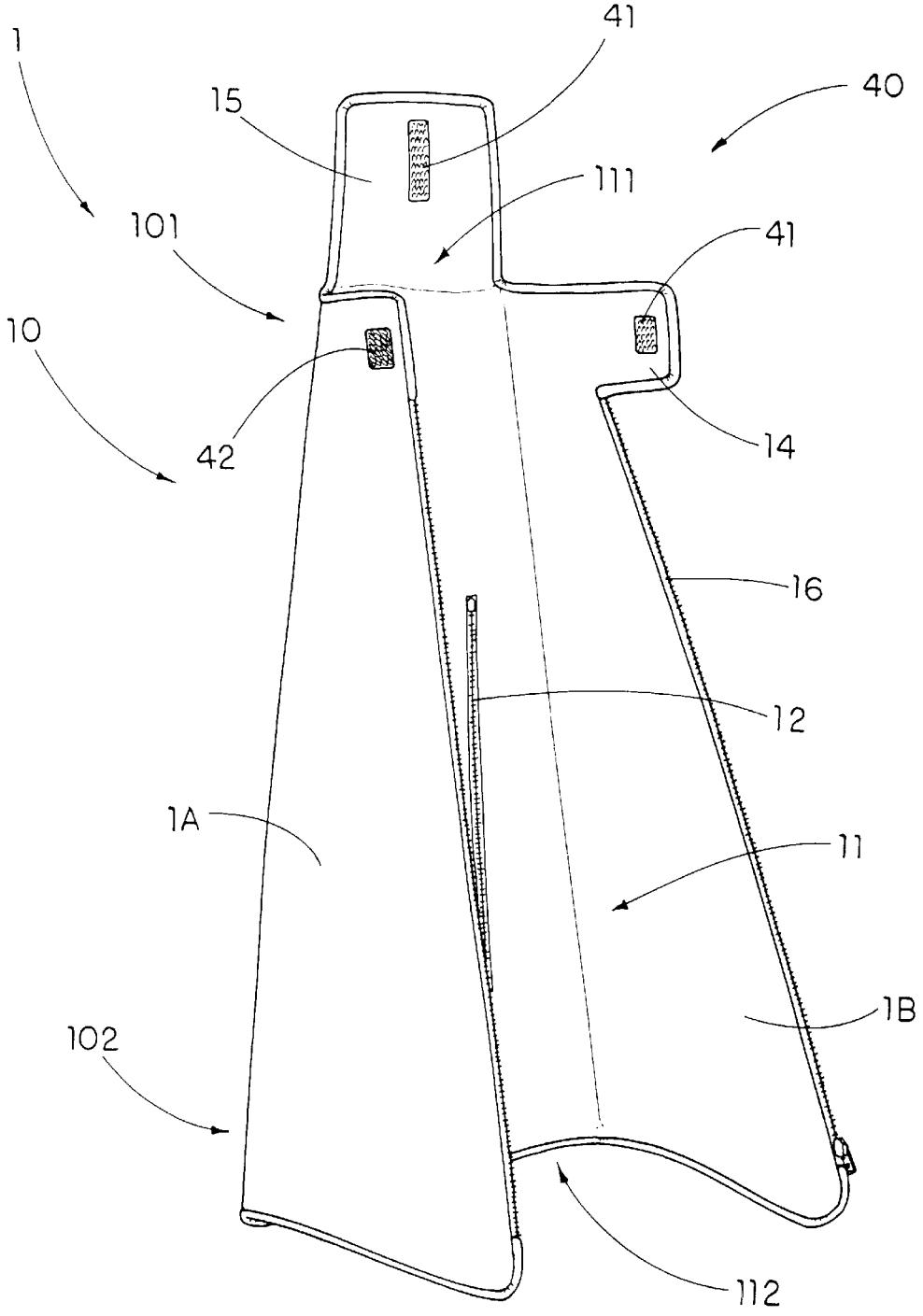
FIG. 2 is a perspective view of a guitar cover for protecting a guitar supported on a guitar stand according to a preferred embodiment of the present invention.

Referring to FIG. 2 of the drawings, a guitar cover 1 according to a preferred embodiment of the present invention is illustrated, wherein the guitar cover 1 is adapted for protecting a guitar 2 supported on a guitar stand 3.

Accordingly, the guitar stand 3 as mentioned in the background comprises a floor standing frame 31 for stabilization of the guitar stand 3, a supporting shaft 32 upwardly extended from the floor standing frame 31, and two Y-shaped holding arms 33 outwardly extended from the supporting shaft 32 for holding the guitar 2 in an upright position. Normally, one of the holding arms 33 is held on a head portion of the guitar 2 and the other holding arm 33 is held at a bottom of the guitar 2.

The guitar cover 1, according to the preferred embodiment, comprises an outer layer 1A and an inner lining 1B bonded to the outer layer 1A. The outer layer 1A is made of durable, waterproof, and flexible material such as polyurethane since the outer layer 1A is exposed to surroundings and protects the inner lining 1B such that the outer layer 1A should last for a long time. The inner lining 1B provides a soft and smooth surface in contact with the guitar 2 and is preferably made of nylon. An irregular shape of the guitar 2 is capable of fitting into the guitar cover 1 which is made of stretchable material.

The guitar cover 1 comprises a tubular body cover 10 having a top opening 111 and a bottom opening 112 to define a receiving chamber 11 for fittedly receiving the guitar 2 therein wherein the bottom opening 112 is wider than the top opening 111 so as to form a trapezoid shape of body cover 10 to fit the shape of the guitar 2. In other words, the guitar 2 having an enlarged base portion and the elongated head portion is fitted into the trapezoid shape of the body cover 10 wherein when the guitar 2 has a longer size, the head portion of the guitar 2 is adapted to be upwardly extended from the receiving chamber 11 to outside through the top opening 111.

The body cover 10 further has a back slit 12, a front slit 13, an adjustable head flap 14, a shield flap 15, and an attaching means 16.

Figure 4:
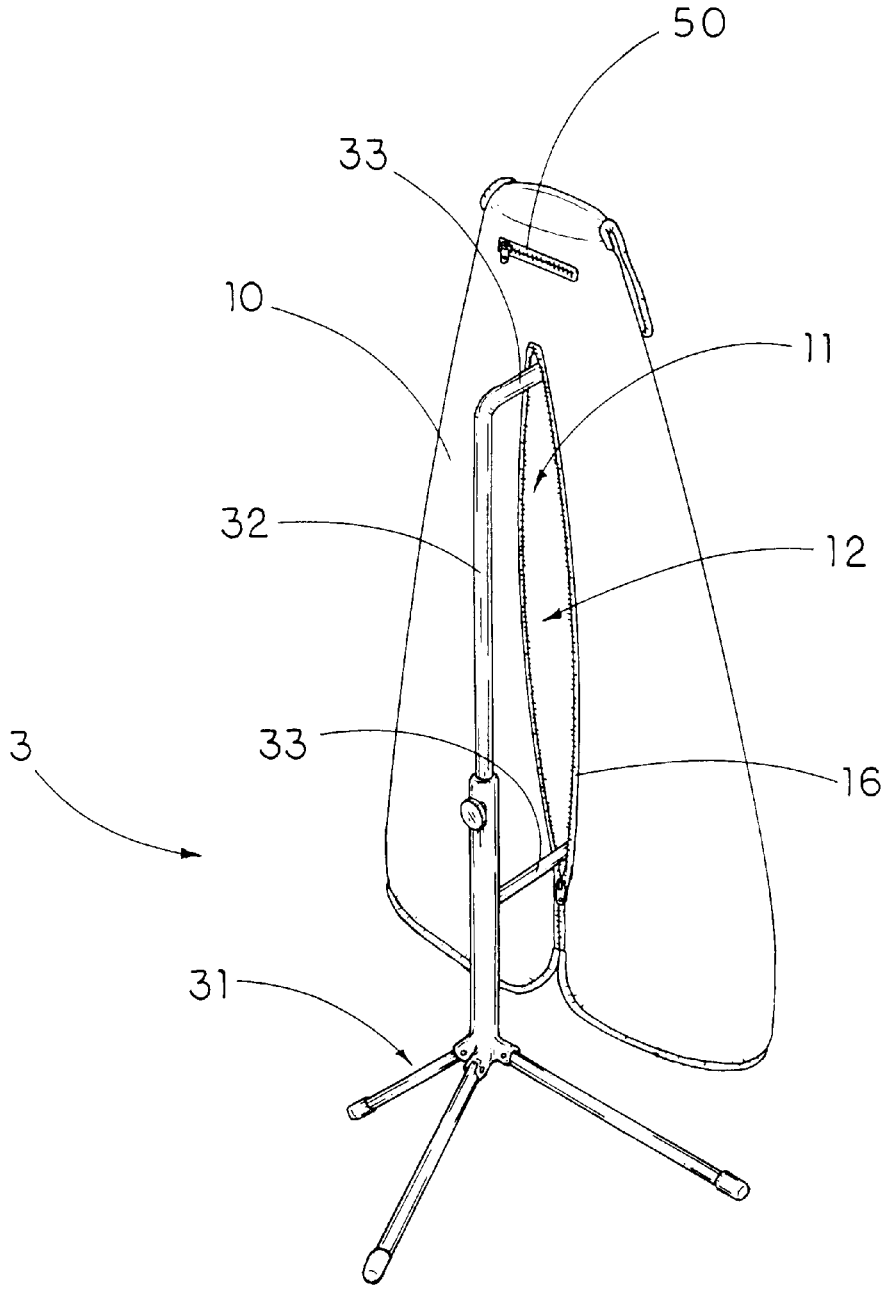
FIG. 4 is a rear perspective view of the guitar cover for protecting a guitar supported on a guitar stand according to the above preferred embodiment of the present invention.
Figure 5:
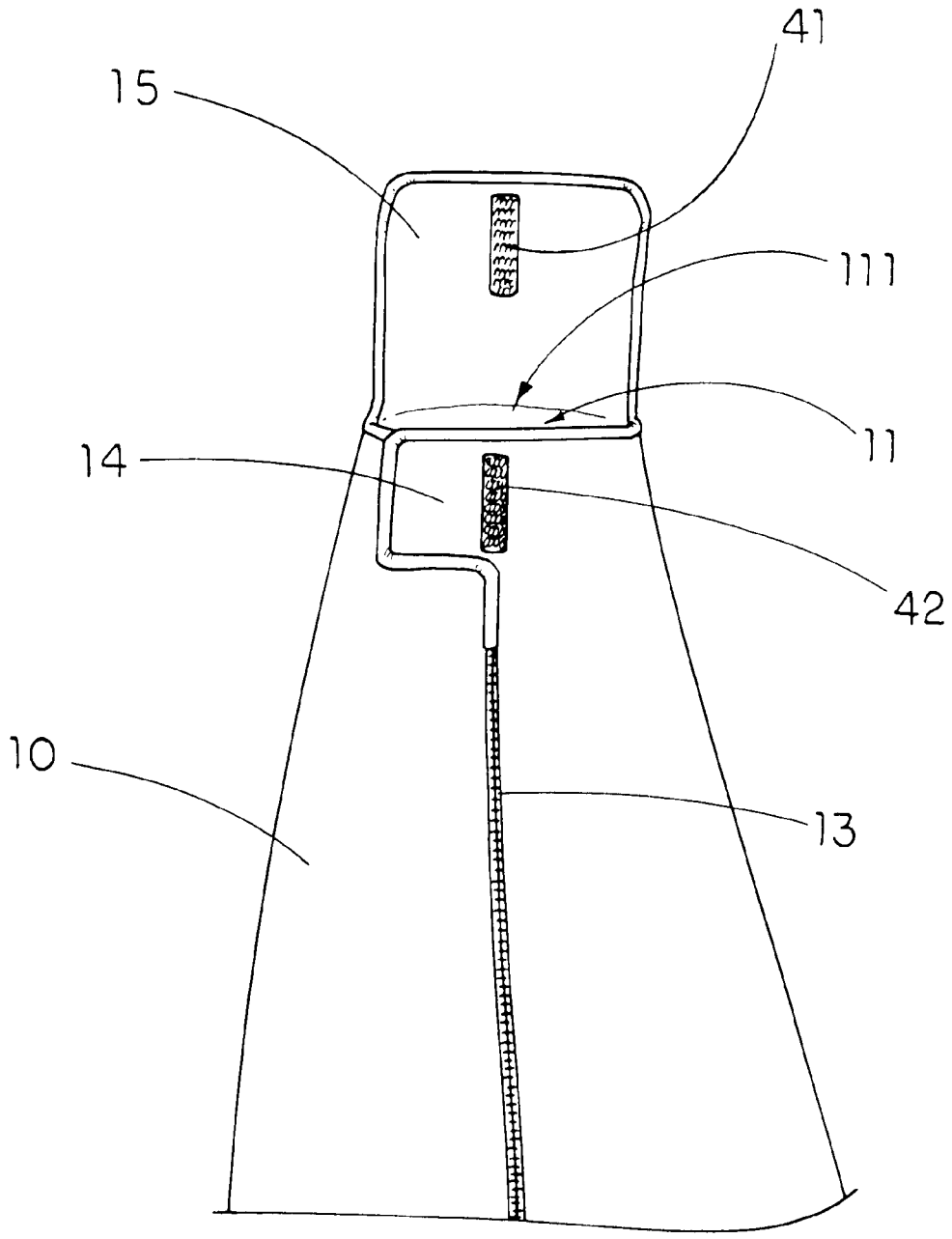
FIG. 5 is a perspective view of an adjustable head flap of the guitar cover for protecting a guitar supported on a guitar stand according to the above preferred embodiment of the present invention.

As shown in FIG. 4, the back slit 12 is vertically formed on a back side of the body cover 10 to communicate the receiving chamber 11 to outside from the back side of the body cover 10 wherein the back slit 12 is upwardly extended from the bottom portion 102 of the body cover 10. So, the holding anus 33 of the guitar stand 3 are capable of extending into the receiving chamber 11 through the back slit 12 to hold the guitar 2 in position when the guitar 2 is supported on the guitar stand 3. It is worth to mention that the back slit 12 has a length must be longer than a distance between the two holding arms 33 of the guitar stand 3 such that the two holding arms 33 are capably of extending into the receiving chamber 11 through the back slit 12.

Figure 3:
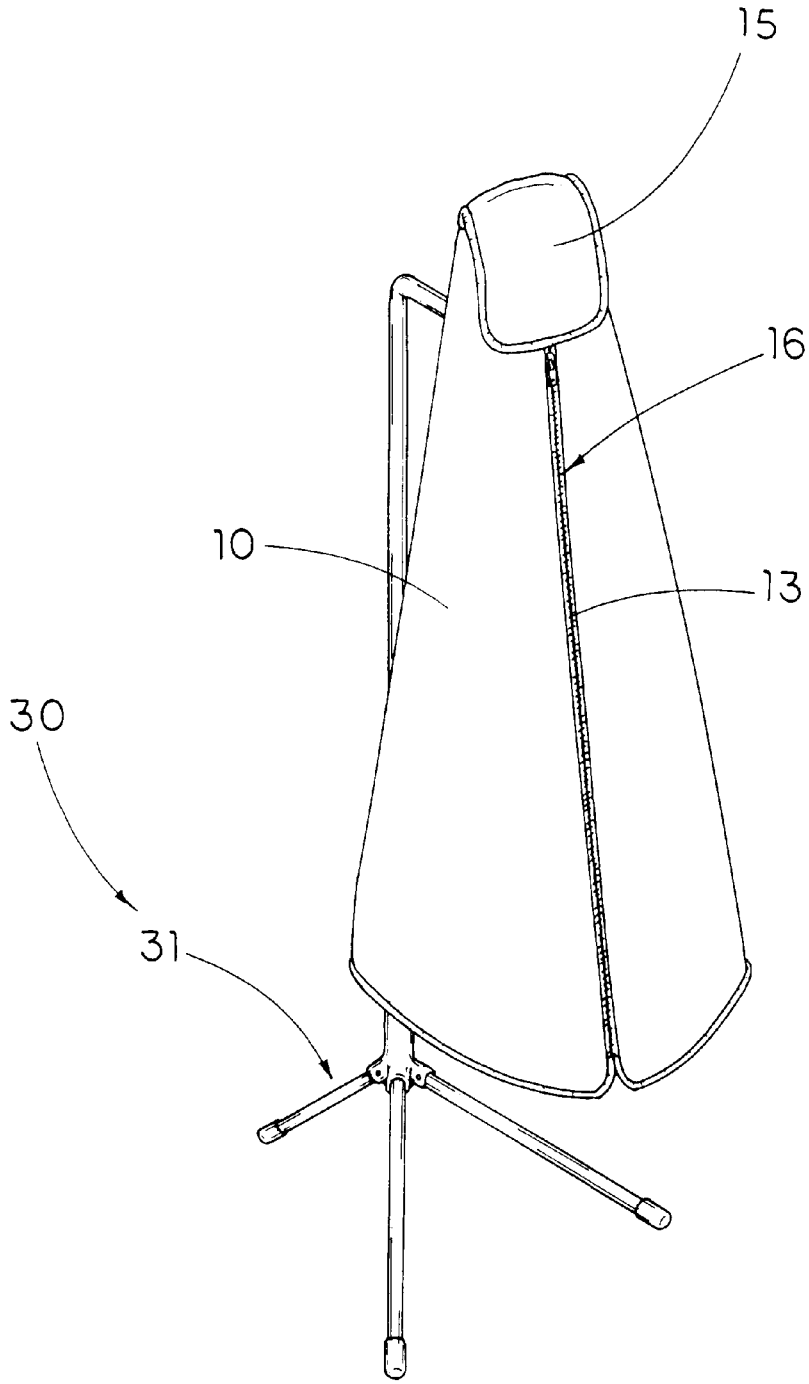
FIG. 3 is a front perspective view of the guitar cover for protecting a guitar supported on a guitar stand according to the above preferred embodiment of the present invention.

Referring to FIGS. 2 and 3, the front slit 13 is vertically formed on a front side of the body cover 10 to communicate the receiving chamber 11 to outside from the front side of the body cover 10. The front slit 13 is downwardly extended from a head portion 101 of the body cover 10 to the bottom portion 102 thereof in such a manner that the guitar 2 is adapted for receiving into the receiving chamber 11 through the front slit 13.

The head flap 14 is integrally extended from one edge of the front slit 13 of the body cover 10 at the head portion 101 thereof wherein the head flap 14 is adapted for overlapping on another side of the front slit 13 so as to selectively adjust a width of the top opening 111. Since each guitar 2 has its own shape, the head flap 14 can selectively adjust the diameter of the top opening 101 to fit for the head portion of the guitar 2.

The shield flap 15 is integrally and upwardly extended from the head portion 101 of the back side of the body cover 10 wherein the shield flap 15 having a size is adapted for overlapping on the front side of the body cover 10 in order to close the top opening 101 of the receiving chamber 11 for protecting the head portion of the guitar 2.

According to the preferred embodiment, the attaching means 16 are provided on the front slit 13 and the back slit 12 respectively for securely closing the front slit 13 and the back slit 12, so as to prevent dust and dirt entering into the receiving chamber 11 from the Front slit 13 and the back slit 12. The attaching means 16 are zippers attached to the edges of the front slit 13 and the back slit 12 respectively such that the user is able to quickly and easily open and close the front slit 13 and the back slit 12. Preferably, the back slit 12 is zip up at the bottom portion 102 of the body cover 10 towards to the holding arm 33 of the guitar stand 3 in such a manner that the back slit 12 is adjustably opened for the two holding arms 33 extending into the receiving chamber 11, as shown in FIG. 4. In other words, the guitar cover 1 can be mounted on the guitar stand 3 in position when the back slit 12 is partially closed to retain the guitar cover 1 on the guitar stand 3.

The guitar cover 1 further comprises a pair of first and second fastening elements 41, 42 wherein the first fastening element 41 is provided on the inner lining 1B of the head flap 14 and the second fastening element 42 is provided on the corresponding outer layer 1A of the head portion 101 of the body cover 10 in such a manner that the head flap 14 is adapted for detaching attaching to the head portion 101 of the body cover 10 to adjust the width of the top opening 111.

Furthermore, the first fastening element 41 can also be provided on the inner lining 1B of the shield flap 15 and the second fastening element 42 can be provided on the outer layer 1A of the corresponding head portion 101 of the body cover 10 such that the shield flap 15 is adapted for detachably attaching to the head portion 101 of the body cover 10 to securely close the top opening 111 of the receiving chamber 11. Accordingly, the first and second fastening elements 41, 42 are loop and hoop fasteners so as to provide an easy and quick attachment therebetween.

The guitar cover 1 further comprises an accessory pocket 50 for placing accessories such as picks wherein the accessory pocket 50 is integrally formed on the outer layer 1A of the back side of the body cover 10. A zipper is provided at an opening of the accessory pocket 50 for tightly closing the accessory pocket 50 so as to securely place the accessories inside the accessory pocket 50.

In order to use the guitar cover 1, the user can mount the guitar cover 1 on the guitar stand 3 while the holding arms 33 are extended into the receiving chamber 11 of the guitar cover 1 through the back slit 12. Then, the user can adjustably close the back slit 12 by the attaching means 16 so as to retain the guitar cover 1 on the guitar stand 3. While opening the front slit 13, the guitar 2 is adapted for vertically receiving into the receiving chamber 11 such that the user is able to adjustably attach the head flap 14 on the head portion 101 of the guitar cover 1 so as to selectively hold the head portion of the guitar 2 in position. Simply fold the shield flap 15 on the head portion 101 of the guitar cover 1, the top opening 111 of the receiving chamber 11 is closed so as to protect the head of the guitar 2. The user can simply flip over the shield flap 15, detach the head flap 14 from the body cover 10, and open the front slit 13, the guitar 2 can easily withdraw from the guitar cover 1. So, the user is hassle-free to cover and uncover the guitar 2 every time when he or she wants to play the guitar 2. Thus, since the floor standing frame 31 and the supporting shaft 32 of the guitar leave uncovered, the guitar 2 will be remain supported rigidly by the guitar stand 2 while the guitar cover 1 is incorporated with the guitar stand.

It is worth to mention that since the guitar cover 1 does not cover up the main supporting frame of the guitar stand which is the floor standing frame and the supporting shaft, the guitar cover 1 is capable of incorporating with a multiple guitar stand for supporting at least one guitar at once, wherein a plurality of holding arms are coaxially extended from the supporting shaft for holding the guitars respectively.

While the foregoing description describe the preferred embodiment of the present invention, it should be appreciated that certain obvious modifications, variations, and substitutions may be made without departing from the spirit and scope of the present invention.

What is claimed is:

1. A guitar cover for protecting a guitar while supporting on a guitar stand which comprises a floor standing frame for stabilization of said guitar stand, a supporting shaft upwardly extended from said floor standing frame, and two holding arms outwardly extended from said floor standing frame for holding said guitar in an upright position, wherein said guitar cover comprises:

a tubular body cover having a top opening, a bottom opening and a receiving chamber provided between said top opening and said bottom opening for fittedly receiving said guitar therein, wherein a back slit is formed on a back side of said body cover to communicate said receiving chamber with outside in such a manner that said holding arms of said guitar stand are adapted for extending into said receiving chamber through said back slit to hold said guitar in position.

2. The guitar cover, as recited in claim 1, wherein said body cover further comprises a shield flap integrally and upwardly extended from a head portion of said back side of said body cover, wherein said shield flap is arranged to be capable of overlapping on a front side of said body cover to close said top opening of said receiving chamber for protecting a head portion of said guitar.

3. The guitar cover, as recited in claim 2, wherein a first fastening element is provided an inner lining of said shield flap and a second fastening element is provided on an outer layer of said corresponding head portion of said body cover such that said shield a flap is adapted for detachably attaching to said head portion of said body cover to securely close said top opening of said receiving chamber.

4. The guitar cover, as recited in claim 3, wherein said first fastening element and said second fastening element are loop and hoop fasteners respectively.

5. The guitar cover, as recited in claim 2, wherein said body cover further comprises a front slit vertically formed on a front side of said body cover to communicate said receiving chamber with outside from said front side of said body cover, wherein said front slit is downwardly extended from a head portion of said body cover to a bottom portion thereof in such a manner that said guitar is adapted for receiving into said receiving chamber through said front slit.

6. A guitar cover, as recited in claim 5, wherein two attaching means are respectively provided on said front slit and said back slit for securely closing said front slit and said back slit, so as to prevent dust and dirt entering into said receiving chamber.

7. The guitar cover, as recited in claim 5, wherein a first fastening element is provided an inner lining of said shield flap and a second fastening element is provided on an outer layer of said corresponding head portion of said body cover such that said shield flap is adapted for detachably attaching to said head portion of said body cover to securely close said top opening of said receiving chamber.

8. The guitar cover, as recited in claim 7, wherein said first fastening element and said second fastening element are loop and hoop fasteners respectively.

9. A guitar cover, as recited in claim 5, wherein said body cover further comprises a head flap integrally extended from one edge of said front slit of said body cover at said head portion thereof wherein said head flap is arranged to be capable of overlapping on another side of said front slit so as to selectively adjust a width of said top opening of said receiving chamber.

10. The guitar cover, as recited in claim 9, further comprising a first fastening element provided on an inner lining of said head flap and a second fastening element provided on a corresponding outer layer of said head portion of said body cover in such a manner that said head flap is adapted for detaching attaching to said head portion of said body cover to adjust said width of said top opening.

11. The guitar cover, as recited in claim 10, wherein said first fastening element and said second fastening element are loop and hoop fasteners respectively.

12. The guitar cover, as recited in claim 9, wherein two attaching means are respectively provided on said front slit and said back slit for securely closing said front slit and said back slit, so as to prevent dust and dirt entering into said receiving chamber.

13. The guitar cover, as recited in claim 12, wherein said two attaching means are zippers respectively attached to edges of said front slit and said back slit.

14. The guitar cover, as recited as in claim 12, further comprising a first fastening element provided on an inner lining of said head flap and a second fastening element provided on a corresponding outer layer of said head portion of said body cover in such a manner that said head flap is adapted for detaching attaching to said head portion of said body cover to adjust said width of said top opening.

15. The guitar cover, as recited in claim 14, wherein said first fastening element and said second fastening element are loop and hoop fasteners respectively.

16. The guitar cover, as recited in claim 1, wherein said body cover further comprises a front slit vertically formed on a front side of said body cover to communicate said receiving chamber with outside from said front side of said body cover, wherein said front slit is downwardly extended from a head portion of said body cover to a bottom portion thereof in such a manner that said guitar is adapted for receiving into said receiving chamber through said front slit.

17. The guitar cover, as recited in claim 16, wherein two attaching means are respectively provided on said front slit and said back slit for securely closing said front slit and said back slit, so as to prevent dust and dirt entering into said receiving chamber.

18. The guitar cover, as recited in claim 17, wherein said two attaching means are zippers respectively attached to edges of said front slit and said back slit.

19. The guitar cover, as recited in claim 16, wherein said body cover further comprises a head flap integrally extended from one edge of said front slit of said body cover at said head portion thereof wherein said head flap is arranged to be capable of overlapping on another side of said front slit so as to selectively adjust a width of said top opening of said receiving chamber.

20. The guitar cover, as recited in claim 19, wherein two attaching means are respectively provided on said front slit and said back slit for securely closing said front slit and said back slit, so as to prevent dust and dirt entering into said receiving chamber.

* * * * *